US006010754A

United States Patent [19]

Tatsumi

[11] Patent Number: 6,010,754

[45] **Date of Patent: *Jan. 4, 2000**

[54] THERMAL HEAD PRODUCING METHOD

[75] Inventor: Yutaka Tatsumi, Kyoto, Japan

[73] Assignee: Rohm Co., Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/978,281

[22] Filed: Nov. 25, 1997

Related U.S. Application Data

[63] Continuation of application No. 08/390,282, Feb. 15, 1995, abandoned, which is a continuation of application No. 08/151,789, Nov. 15, 1993, abandoned, which is a continuation of application No. 07/881,793, May 12, 1992, abandoned.

[30] Foreign Application Priority Data

May 16, 1991 [JP] Japan ..... 3-111461
May 16, 1991 [JP] Japan ..... 3-111462

[51] Int. Cl.[7] ..... B05D 3/06

[52] U.S. Cl. ..... 427/545; 338/308; 219/209; 219/260

[58] Field of Search ..... 204/192.15, 192.2; 338/308; 219/209, 260; 427/545

[56] References Cited

U.S. PATENT DOCUMENTS 4,276,535 6/1981 Mitsuyu et al. ..... 204/192.21 X
4,545,881 10/1985 Shinmi et al. ..... 204/192.15
4,705,697 11/1987 Nishiguchi et al. ..... 204/192.15 X

FOREIGN PATENT DOCUMENTS 0 079 585 5/1983 European Pat. Off. .
63-168369 11/1988 Japan .
2214672 11/1990 Japan .

OTHER PUBLICATIONS

L. I. Maissel et al., *Handbook of Thin Film Technology*, 1970, pp. 18–18 to 18–32.

*Primary Examiner*—Nam Nguyen
*Assistant Examiner*—Steven H. Ver Steeg
*Attorney, Agent, or Firm*—Oliff & Berridge, PLC

[57] ABSTRACT

A thermal head producing method in which dispersion of resistance values of heating resistors in each thermal head and dispersion of the resistance values of the heating resistors per dot unit are made uniform to improve printing quality. A glaze layer is formed on a substrate and a heating resistor composed of a thin film resistor material of a mixed composition of a high melting point metal and an insulating material is formed on the glaze layer. First and second pattern conductors for providing common and separate electrodes are formed on the heating resistor and, after a protective film is formed to cover the first and second pattern conductors and the heating resistor, the heating resistor is heated so as to be a higher temperature than a dot temperature required for a printing operation. Preferably, after a resistor film formed on the glaze layer is annealed under vacuum to prepare the heating resistor, the first and second pattern conductors are formed on the heating resistor, and the protective film is formed in the same manner as described above.

8 Claims, 7 Drawing Sheets

THERMAL HEAD PRODUCING METHOD

This is a Continuation of Application Ser. No. 08/390,282 filed Feb. 15, 1995 now abandoned, which in turn is a Continuation of Application Ser. No. 08/151,789 filed Nov. 15, 1993, now abandoned, which in turn is a Continuation of Application Ser. No. 07/881,793, filed May 12, 1992, now abandoned.

BACKGROUND OF THE INVENTION i) Field of the Invention

The present invention relates to a method for producing a thermal head, and more particularly to a method for producing a thermal head with a uniforming step of resistance values of heating resistors.

ii) Description of the Related Arts

In general, as shown in FIG. 1, a conventional thin film thermal head includes a ceramic substrate 1, a glaze layer 2 formed on the ceramic substrate 1 and a heating resistor 3 formed on the glaze layer 2 and the heating resistor 3 is composed of a thin film resistor material of a mixed composition of a high melting point metal and an insulating material. Then, a first pattern conductor 4 for providing a common electrode and a second pattern conductor 5 for providing separate electrodes are formed on the heating resistor 3 so that a part of the heating resistor 3 may be exposed in a band form, and the first and second pattern conductors 4 and 5 and the exposed part of the heating resistor 3 are covered by a protective film 6 to produce the thin film thermal head. Usually, in order to obtain a predetermined dot number, a plurality of the thin film thermal heads are arranged in a printing scanning direction.

In the thin film thermal head, a dot resistance value is determined by a dot size and a sheet resistance of a resistor film when the resistor film composed of the thin film resistor material of the mixed composition of the high melting point metal and the insulating material is prepared. The dispersion of resistance values of heating resistors in the thermal head can constitute a factor for deteriorating the printing quality and is caused by the dispersion of the sheet resistances of the resistance films and the dispersion of the dot sizes caused by the condition variation of an etching or the like in a photolithographing step.

On the other hand, the primary factor for the dispersion of average resistance values of the heating resistors in each head is due to the dispersion of the sheet resistances of the resistor films produced by sputtering or the like by using a sintered mixture target.

In such a case, by reducing the dispersion of the resistance values, a variety of advantages can be obtained as follows. For example, the printing quality can be improved, and an applied voltage adjusting is not required depending on the resistance values of the heating resistors in each head when a plurality of heads are mounted on a printer. However, there are many technical difficulties for reducing the dispersion of the resistance values.

A variety of methods concerning a trimming process of a thin film resistors have been proposed in order to suppress the dispersion of the resistance values. However, in all of these methods, the shape of the resistor is changed by a laser, a blaster or the like, but this method is not suitable for the thermal head. Hence, it is necessary to suppress the dispersion of the resistance values of the heating resistors without performing the trimming processing. In this case, it is required to strictly control the necessary conditions such as sputtering conditions, sputtering materials, photolithographing conditions and the like in performing various processings in the thermal head producing method. If the conditions are varied a little bit, the dispersion of the resistance values will be caused.

On the other hand, as described above, the thin film resistor material of the mixed composition of the high melting point metal and the insulating material is used in order to realize a high resistivity of the heating resistor. Usually, this thin film resistor material is used for forming a resistor film by a sputtering method using a mixed sintered target. However, in the resistor film of a polygene system material composed of the thin film resistor material, a structural defect of the film is apt to occur and the resistivity of the resistor film is liable to be changed with the variation of the sputtering conditions. That is, as the degree of the vacuum of the sputtering is raised, the resistivity is increased. Hence, if the sputtering conditions are not strictly controlled, the dispersion of the resistance values of the heating resistors is caused. Accordingly, the calorific value is different in the resistors and a density difference is caused in the dot printing, which becomes the primary factor for deteriorating the printing quality.

As described above, conventionally, the problems appearing in the heating resistors composed of the thin film resistor material are summarized as follows.

(1) The strict control of the sputtering conditions is required. That is, the variation of the conditions causes the variation of the resistivity of the heating resistors, and as a result, the dispersion of the resistance values of the resistors is caused after the production of the resistors. This can be the factor for causing the dispersion of the printing quality or grade.

(2) The resistance value of the heating resistor in the thermal head is reduced after the printing. This also causes the dispersion of the printing quality or grade. For example, when a pulse application of the dots printed many times at the initial time as the thermal head and the dots printed not many times is performed, since there is a difference among the resistance values of the resistors constituting the dots, the dispersion is caused in the printing density and the dot size. The dispersion of the printing quality or grade is particularly remarkable in a head for a color printer which strictly requires uniformity of the resistance values per dot unit.

SUMMARY OF THE INVENTION

It is therefore an object of the present invention to provide a thermal head producing method in view of the above-described problems of the prior art, which is capable of uniforming dispersion of resistance values of heating resistors in each thermal head and the dispersion of the resistance values of the heating resistors per dot unit to improve printing quality, and uniforming the dispersion of the resistance values of the heating resistors by each head to negate necessity of an applied voltage adjustment at a mounting of a plurality of heads.

It is another object of the present invention to provide a thermal head producing method in view of the above-described problems of the prior art, which is capable of stabilizing the resistance values of the heating resistors to improve printing quality when not only the heating resistors are produced but also a printing operation as a thermal head is repeated after producing the heating resistors.

In order to achieve these objects, in accordance with one aspect of the present invention, there is provided a method for producing a thermal head having a heating resistor composed of a thin film resistor material of a mixed composition of a high melting point metal and an insulating material, comprising applying an electric power to the heating resistor after forming a protective film so that the heating resistor is heated to a higher temperature than a dot temperature required for a printing operation.

In the thermal head producing method of the present invention, since the step for applying the power to the heating resistor is provided, the resistance value of the resistor can be reduced to a predetermined value. This step can adjust the resistance value of the resistor without changing the shape of the resistor, and thus this can be considered as a kind of a trimming process from its processing function. Hence, this step can be hereinafter called a trimming step.

In the thermal head producing method according to the present invention, as described above, the feature is that there is provided with the step for applying the power to the heating resistor after the protective film is formed, and the steps up to the protective film formation can be carried out in a conventional manner. That is, first, the thin film resistor material of the mixed composition of the high melting point metal and the insulating material, for example, is applied on a substrate (actually on a glaze layer formed on the substrate) to form a heating resistor film by a sputtering method using a mixed sintered target. Then, conductor films for common and separate electrodes are formed on the resistor film, and, after a photoetching is applied to the conductor films to form the desired electrode pattern, the protective film is formed thereon. Then, the feature of the present invention, that is, the trimming step is carried out. In this step, it is essential to apply the power to the resistor film, and this power is for heating the resistor film to the higher temperature than the dot temperature required for the printing operation. The detail of the applied power is described in the preferred embodiments.

Further, in accordance with another aspect of the present invention, there is provided a thermal head producing method including a step for forming a heating resistor composed of a thin film resistor material of a mixed composition of a high melting point metal and an insulating material, comprising annealing the heating resistor under vacuum after forming a protective film.

In the thermal head producing method according to the present invention, it is hard to change the resistance value of the resistor after the printing as the thermal head or during the preparation of the heating resistor, and the resistance value of the resistor is stable. Hence, the printing quality can be hardly deteriorated. Also, it is needless to strictly control the sputtering conditions during the resistor preparation as in the conventional method.

In the thermal head producing method of the present invention, the thin film resistor material of the mixed composition of the high melting point metal and the insulating material can be applied on a substrate (actually on a glaze layer formed on the substrate) to form a heating resistor film by a sputtering method using a mixed sintered target in a conventional manner. After this sputtering, the resistor film is annealed under vacuum to form the heating resistor. In this case, the temperature in the annealing is essential, and the essential annealing temperature is the higher temperature than the dot temperature required for the printing operation. The detail of the annealing temperature is described in the preferred embodiments.

Further, the steps before and after the heating resistor formation step can be performed in a conventional manner, and the conventional thin film resistor material constituting the heating resistor can be used as it is.

BRIEF DESCRIPTION OF THE DRAWINGS

These and other objects, features and advantages of the present invention will become more apparent from the consideration of the following detailed description, taken in conjunction with the accompanying drawings, in which.

DESCRIPTION OF THE PREFERRED EMBODIMENTS

The present invention will now be described in connection with its preferred embodiments with reference to the accompanying drawings.

Figure 1:
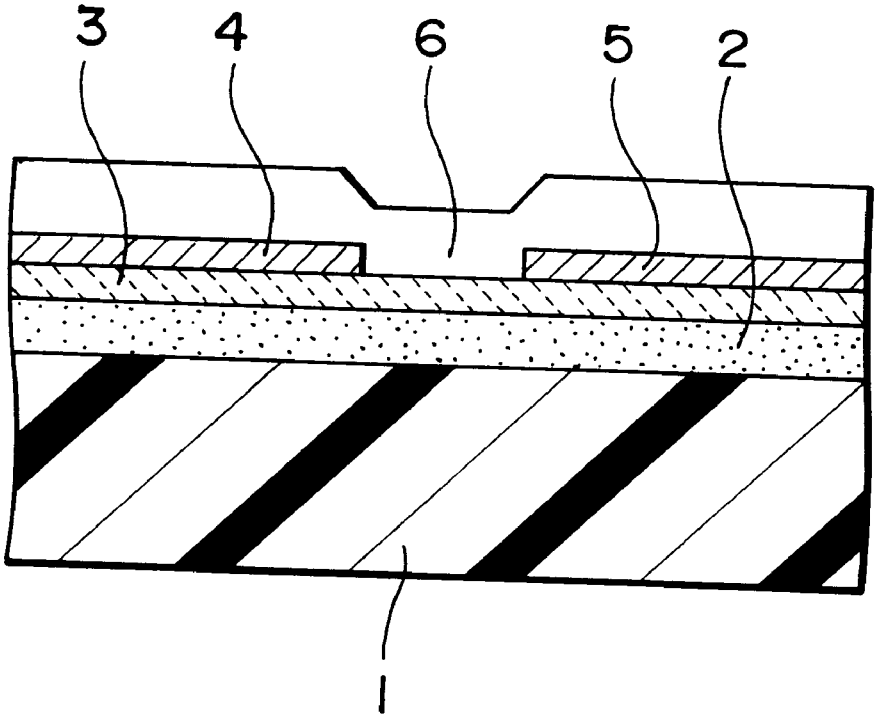
FIG. 1 is a cross sectional view of a thermal head produced according to a present method as well as a conventional method.

FIG. 1 shows a cross section of a thin film thermal head produced by a thermal head producing method according to the present invention, having a similar structure to the above-described conventional thermal head.

As shown in FIG. 1, in this instance, a glaze layer 2 is formed on a ceramic substrate 1, and a heating resistor 3 composed of a thin film resistor material of a mixed composition of a high melting point metal and an insulating material is formed on the glaze layer 2. Then, a first pattern conductor 4 for providing a common electrode and a second pattern conductor 5 for providing separate electrodes are formed on the heating resistor 3 so that a part of the heating resistor 3 may be exposed in a band form, and the first and second pattern conductors 4 and 5 and the exposed part of the heating resistor 3 are covered by a protective film 6 to produce the thin film thermal head. In this case, after the protective film 6 is formed, an electric power is applied to the heating resistor film 3 so that the heating resistor film 3 may be heated to a temperature higher than a dot temperature required at a printing operation.

Next, before a trimming step of the heating resistor 3 of the thermal head in the producing method according to the present invention is described, the electric power to be applied to the heating resistor 3 is described as follows.

Figure 2:
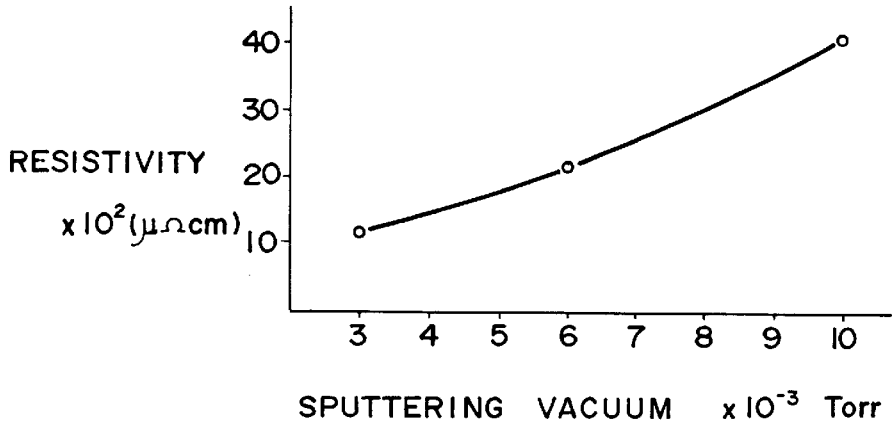
FIG. 2 is a graphical representation showing a relationship between a resistivity and a sputtering vacuum degree for explaining characteristics of a heating resistor composed of a thin film resistor material of a mixed composition of a high melting point metal and an insulating material according to the present invention.

The thin film resistor material of the mixed composition of the high melting point metal and the insulating material for the heating resistor 3 is used for realizing a high resistivity of the heating resistor 3. The film formation of this thin film resistor material is generally performed by a sputtering method using a mixed sintered target. However, as to the resistor film of a polygene system material composed of the thin film resistor material, a structural defect of the film is apt to occur, and as shown in FIG. 2, the resistivity of the resistor film is liable to be changed with the variation of the sputtering conditions. That is, it is readily understood that, as the degree of the vacuum of the sputtering is raised, the resistivity is increased, as shown in FIG. 2.

Figure 3:
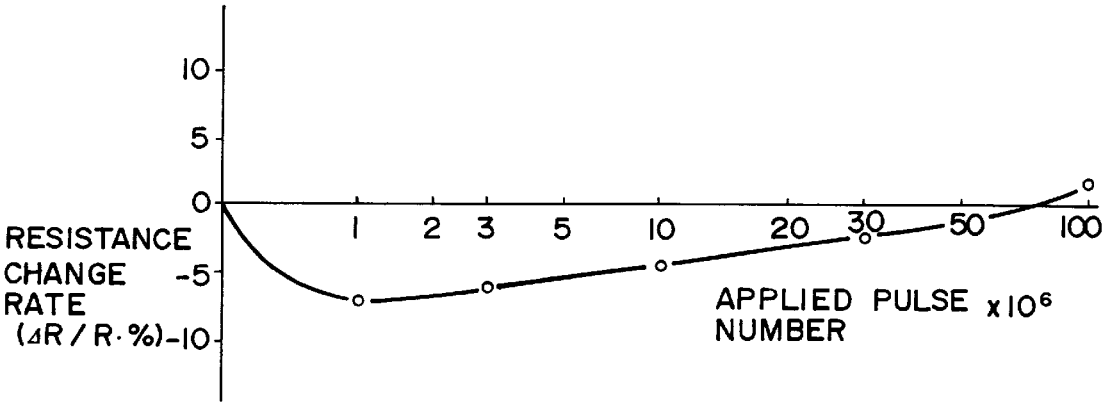
FIG. 3 is a graphical representation showing a relationship between a resistance change rate and an applied pulse number in a relief-printing continuous application test for explaining the characteristics of the heating resistor composed of the thin film resistor material of the mixed composition of the high melting point metal and the insulating material according to the present invention.

Further, in the thermal head using the heating material of the thin film resistor material, a relief-printing continuous application test under conditions such as a pulse width of 1.0 ms, a period of 10 ms and 0.3 mj/dot is carried out on the basis of an applied energy for obtaining a printing density D=1.2 and the result of this test is shown in FIG. 3. FIG. 3 shows a relationship between a resistance value change rate of the heating resistor and an applied pulse number. From FIG. 3, approximately 7% of resistance value drop in the pulse applying period can be recognized. This can be considered as follows. That is, due to the heating by applying the pulse, the rearrangement of the structural defect within the resistor film is caused and the strain is lightened to drop the resistance value by a so-called annealing effect.

In the thermal head producing method according to the present invention, a phenomenon to be understood from the relationship between the resistivity and the sputtering vacuum degree and the relationship between the resistance value change rate and the applied pulse number is positively used for controlling the resistance value of the heating resistor in the trimming step.

Figure 4:
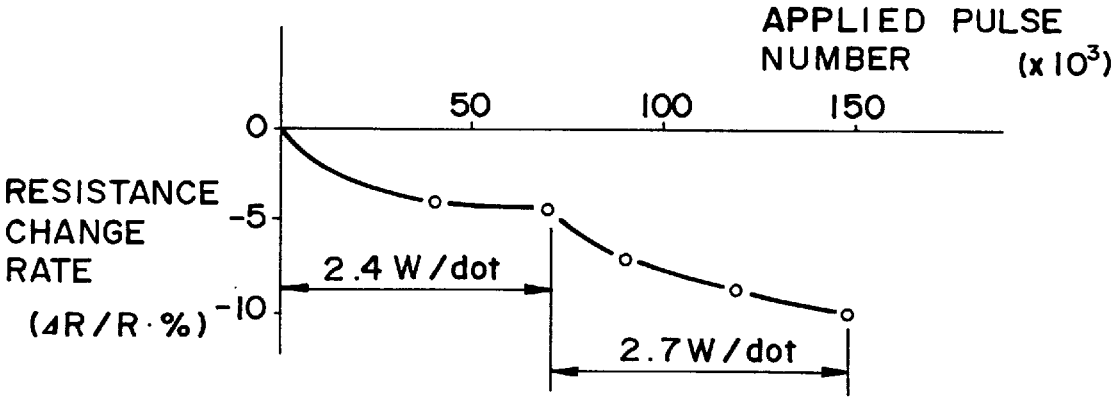
FIG. 4 is a graphical representation showing a relationship between the resistance change rate of the heating resistor and the applied pulse number in 2.4 W/dot and 2.7 W/dot for explaining a thermal head producing method according to the present invention.
Figure 5:
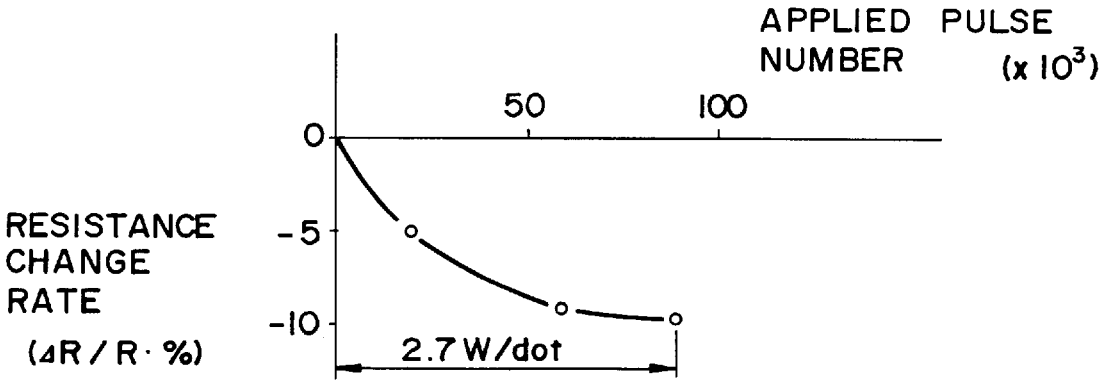
FIG. 5 is a graphical representation showing a relationship between the resistance change rate of the heating resistor and the applied pulse number in 2.7 W/dot for explaining a thermal head producing method according to the present invention.

On the other hand, FIG. 4 shows a relationship between the applied pulse number and the resistance value change rate when the electric power of 2.4 W/dot is applied to the heating resistor in the initial period, and after the stable tendency of the resistance value of the resistor is recognized, the applied electric power is increased to 2.7 W/dot. Further, FIG. 5 illustrates a relationship between the applied pulse number and the resistance value change rate when the electric power of 2.7 W/dot is applied to the heating resistor from the initial period to the end. From the relationship shown in FIGS. 4 and 5, the resistance value can be adjusted in a trimming step A shown in FIG. 6 or a trimming step B shown in FIG. 7.

Figure 6:
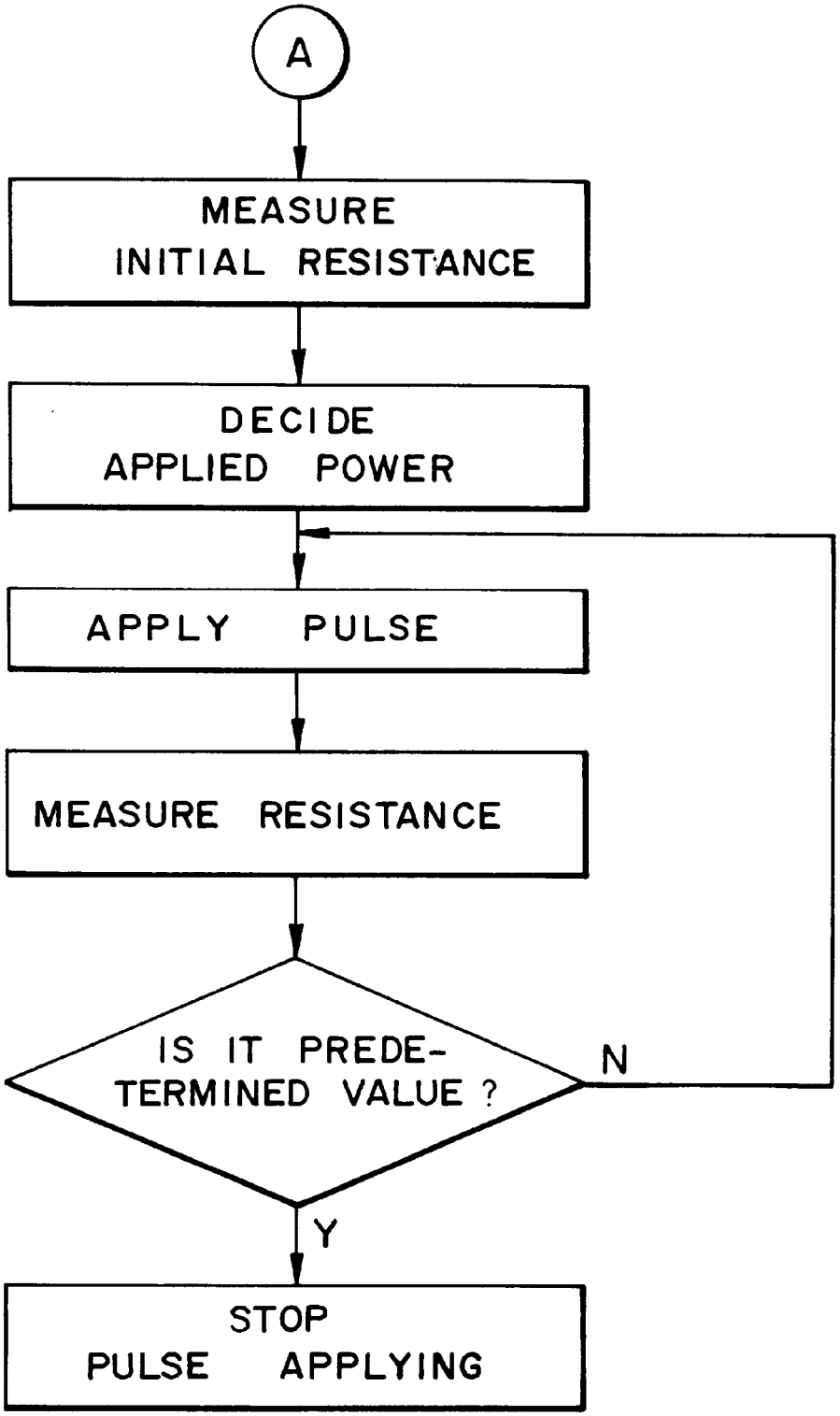
FIG. 6 is a flow chart of one embodiment of a trimming step of a thermal head producing method according to the present invention.
Figure 7:
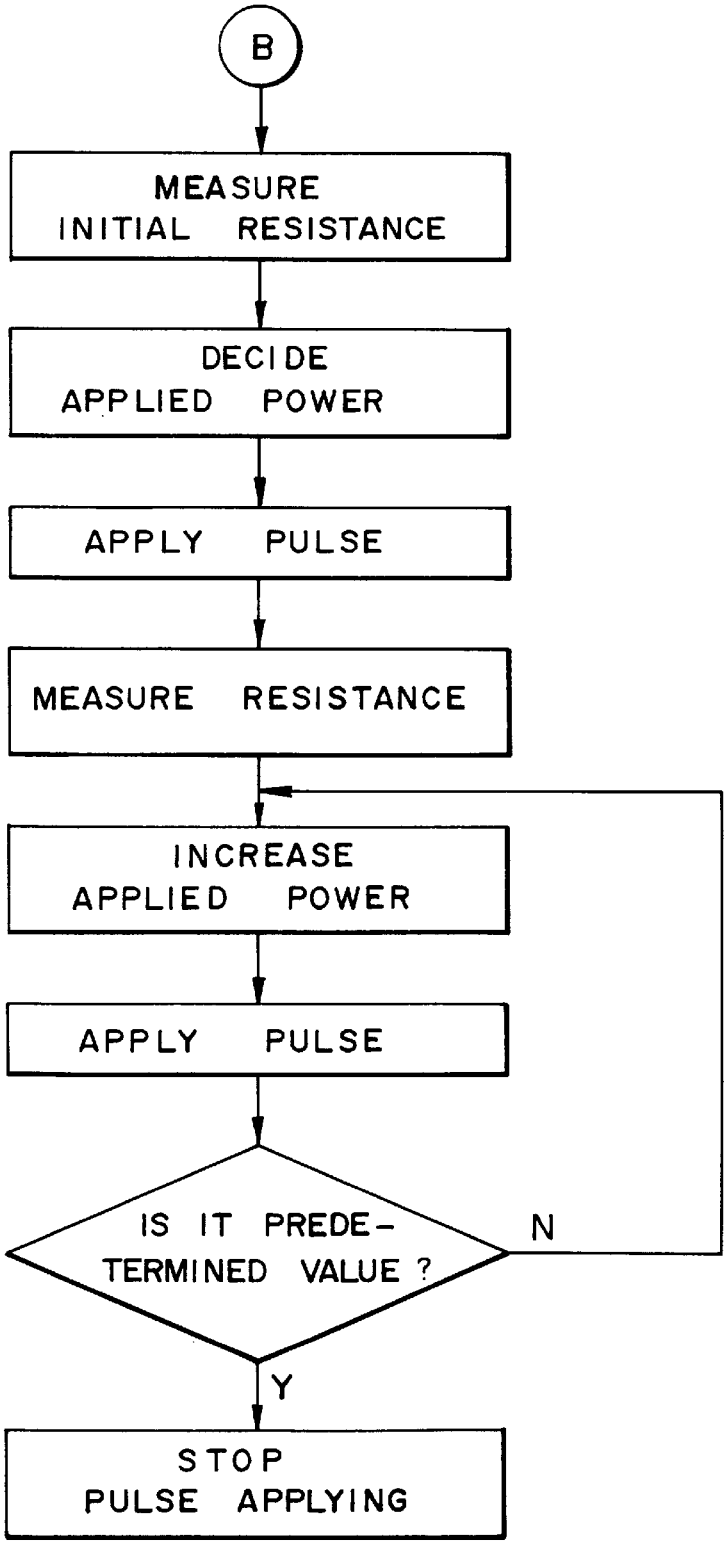
FIG. 7 is a flow chart of another embodiment of a trimming step of a thermal head producing method according to the present invention.

In the trimming step A, as shown in FIG. 6, an initial resistance value measuring step, an applied electric power decision step, a pulse application step and a resistance value measuring step are consecutively carried out, and then it is discriminated whether or not the measured resistance value is a predetermined value. When it is discriminated that the resistance value is the predetermined value, a pulse applying is stopped to finish the trimming step. In turn, when it is discriminated that the resistance value is not the predetermined value, the process is returned to the pulse application step, and then the process is continued as described above until the measured resistance value is the predetermined value. In the trimming step B, as shown in FIG. 7, an applied power increase step and another pulse application step are inserted after the resistance value measuring step in the trimming step A, and, when it is discriminated the the measured resistance value is not the predetermined value in the resistance value discrimination step, the process is returned to the applied power increase step. The other steps in the trimming step B are carried out in the same manner as the trimming step A.

In turn, the stability of the resistance value of the resistor during the using as the thermal head depends on the applied electric power for adjusting the resistance value. Then, this point will now be described.

Figure 8:
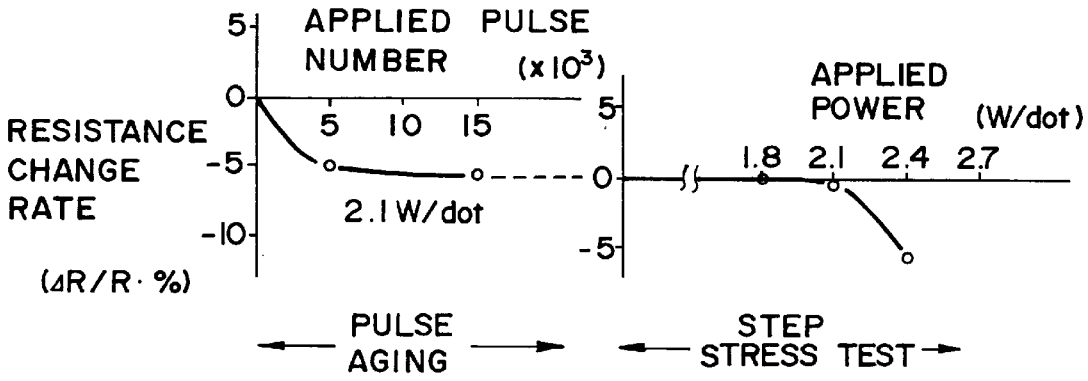
FIG. 8 is a graphical representation showing a relationship between the resistance change rate of the heating resistor and the applied pulse number (left hand side) and a relationship between the resistance change rate and an applied electric power (right hand side) in 2.1 W/dot for explaining a thermal head producing method according to the present invention.

First, the left hand side graph in FIG. 8 shows a result of a pulse aging or a relationship between the resistance value change rate of the heating resistor and the applied pulse number when the electric power of 2.1 W/dot is applied to the resistor. In this graph, the resistance value becomes a stable trend at the pulse number of $15\times10^3$. For the thermal head having the resistor with the stable tendency, a step stress test is carried out on the basis of the resistance value of the resistor after the stabilization thereof, and as a result, a relationship between the resistance value change rate and the applied power is shown in the right hand side graph in FIG. 8. From the right hand side graph in FIG. 8, it is understood that the resistance value change is small up to the power required to the stabilization (2.1 W/dot) and the resistance value reduction can be recognized at the power applied more than the stabilization power.

Figure 9:
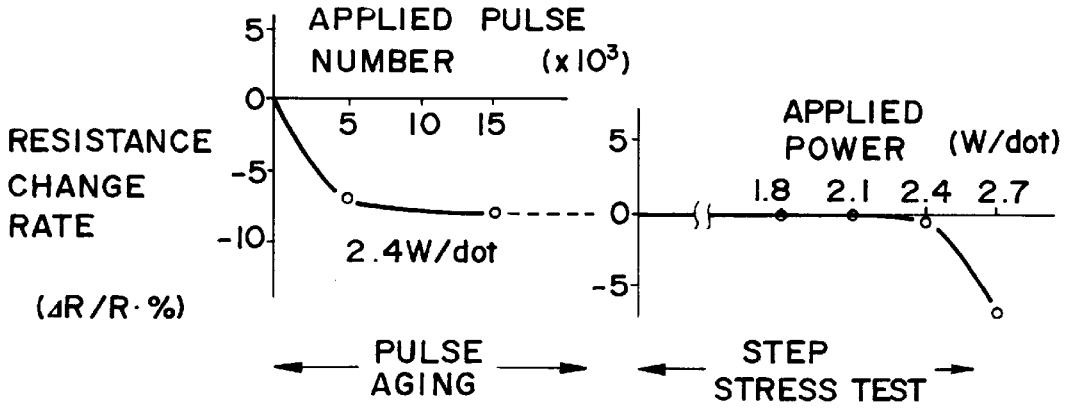
FIG. 9 is a graphical representation showing a relationship between the resistance change rate of the heating resistor and the applied pulse number (left hand side) and a relationship between the resistance change rate and an applied electric power (right hand side) in 2.4 W/dot for explaining a thermal head producing method according to the present invention.

Further, the left hand side graph in FIG. 9 shows a result of a pulse aging when the power of 2.4W/dot is applied to the resistor. When the applied power is increased, the resistance value change rate is enlarged until the resistance value is stabilized (application of $15\times10^3$ pulse number), and after the stabilization of the resistance value, the result of the phenomenon is similar to the above-described case in connection with FIG. 8. A step stress test shown in the right hand side graph in FIG. 9 is also similar to the case shown in FIG. 8.

It is understood from the relationship shown in FIGS. 8 and 9 that the last pulse applied for the trimming processing must be the pulse of the power at least more than that applied at the using time in order to obtain the stability of the resistance value of the resistor in the using state as the thermal head.

From the above-description, the actual process of the trimming step is obtained as follows.

(1) The pulse aging is carried out under the conditions such as the applied pulse number, the applied electric power and the like so that the heating temperature may be more than the heating temperature (dot temperature) of the heating resistor under the printing conditions such as the heating temperature of the heating resistor, the applied electric power and the like of the designed thermal head, and then the resistance value change rate is measured at the time when the resistance value of the resistor is stabilized on the basis of the pulse aging.

(2) The sheet resistance value of the resistor film is determined so as to be within the resistance value change rate obtained in (1), and this sheet resistance value is settled as a target resistance value when the thin film resistor material of the mixed composition of the high melting point metal and the insulating material is formed on the glaze layer to obtain the heating resistor film by the sputtering method using the mixed sintered target.

(3) On the basis of the application conditions determined in (1), a single or a plurality of pulses are applied to the resistor film in order to adjust the resistance value of the resistor film to a predetermined resistance value.

The procedure (1) to (3) is common to both the trimming steps A and B. In case of the trimming step B, it is required to start at least the initial applied power in the procedure (3) from a larger electric power than the applied electric power determined as the printing conditions of the designed thermal head.

By performing the procedure (1) to (3), the trimming step for the heating resistor is completed. Of course, the procedure (1) is carried out separate from the producing process of the thermal head, the procedure (2) is performed after the glaze layer is formed on the substrate, and the procedure (3) is carried out after the protective film is formed over the first and second pattern conductors and the exposed heating resistor.

As described above, in this embodiment, after forming the protective film, the predetermined electric power is applied to the resistor film composed of the thin film resistor material and the following effects can be obtained.

(1) The dispersion of the resistance values of the heating resistors in each thermal head can be removed to make the resistance values uniform.

(2) The dispersion of the resistance values of the heating resistors per dot unit can be removed to make the resistance values uniform.

(3) From (1) and (2), the printing quality can be improved and the printing of high quality as the thermal head can be ensured for a long period of time.

(4) The dispersion of the resistance values of the heating resistors by each thermal head can be removed to make the resistance values uniform.

(5) From (4), it is needless to adjust the electric power applied to each thermal head when a plurality of thermal heads are mounted onto the printer.

Next, another embodiment of a thermal head producing method according to the present invention will now be described in connection with FIGS. 10 and 11. In this embodiment, in the above-described thermal head, an annealing in vacuum is carried out.

Figure 10:
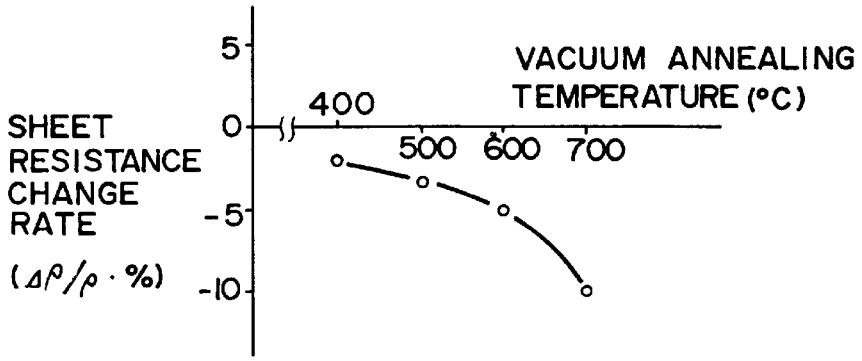
FIG. 10 is a graphical representation showing a relationship between a sheet resistance change rate of a resistor film and a vacuum annealing temperature for explaining a thermal head producing method according to the present invention.
Figure 11:
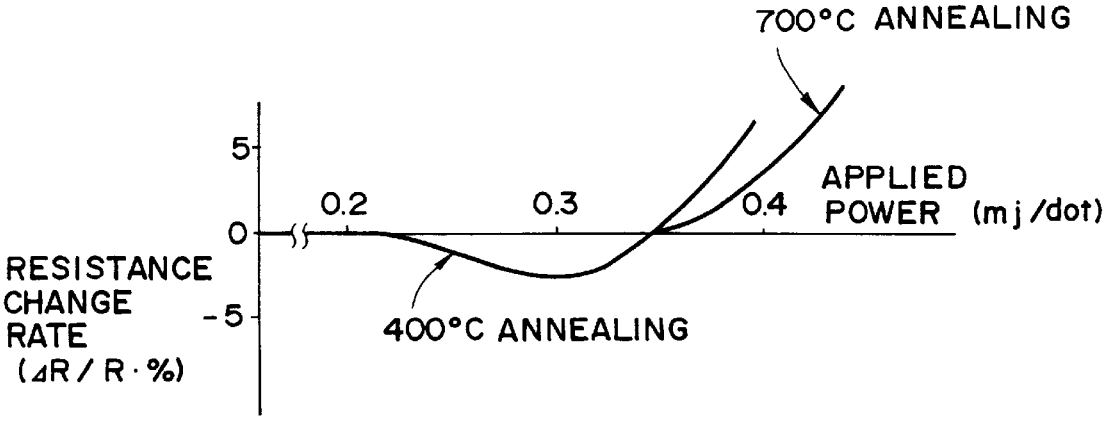
FIG. 11 is a graphical representation showing a relationship between the resistance change rate of the heating resistor and the applied electric power in annealing at 400° C. and 700° C. for explaining a thermal head producing method according to the present invention.

FIG. 10 illustrates a relationship between a vacuum annealing temperature of a resistor film and a sheet resistor value change rate, and FIG. 11 shows a result of a step stress test of a thermal head having a resistor film annealed at 400° C. and 700° C., that is, a relationship between a resistance value change rate and an applied electric power. It is readily understood from FIGS. 10 and 11 that as the vacuum annealing temperature is increased, the resistance value change rate is increased (the resistance value is reduced) in FIG. 10, and that as the applied power is increased, the resistance value change rate is increased (the resistance value is increased) in FIG. 11. Hence, it is presumed that as the vacuum annealing temperature is increased, the stability of the resistance value is increased.

From the above-description, the process for obtaining the optimum annealing condition will now be described.

First, the pulse aging is performed by adding the printing conditions such as the applied pulse number, the applied power and the like of the designed thermal head in the same manner as shown in FIG. 8 or 9, and then the resistance value change rate is measured at the time when the resistance value of the resistor is stabilized on the basis of the pulse aging.

Then, from the graph showing the relationship between the sheet resistance value change rate and the vacuum annealing temperature obtained in advance by an experiment as shown in FIG. 10, the annealing temperature at the time when it is coincident with the resistance value change rate is obtained. This temperature becomes the optimum annealing condition. For example, since the resistance value change rate is approximately −5 ($\Delta R/R\cdot\%$) at the time when it becomes the stable tendency in the pulse aging by 2.1 W/dot shown in the left hand side graph in FIG. 8, the vacuum annealing temperature at the time when the sheet resistance value change rate is −5 in FIG. 10, is approximately 600° C. Similarly, since the resistance value change rate is approximately −8 ($\Delta R/R\cdot\%$) at the time when it becomes the stable tendency in the pulse aging by 2.4 W/dot shown in the left hand side graph in FIG. 9, when adapting to FIG. 10, the vacuum annealing temperature is approximately 680° C.

In this embodiment, the annealing time is varied depending on the printing conditions and the annealing temperature, and approximately 20 to 60 minutes are preferable.

As described above, after the thin film resistor material is formed on the glaze layer to form the resistor film by the common sputtering method using the mixed sintered target, the resistor film is annealed under vacuum at the annealing temperature obtained as described above to prepare the heating resistor with the following effects.

(1) It is unnecessary to strictly control the sputtering conditions when the heating resistor film is formed by using the thin film resistor material, and the dispersion is hardly generated in the resistance values of the heating resistors after the preparation even when the conditions are somewhat varied.

(2) Even after the printing is carried out as the thermal head, the resistance values of the heating resistors are hardly dropped and become stabilized, and thus troubles such as a printing density variation, a dot size variation and the like are not caused.

(3) From (1) and (2), the printing quality can be improved and the the printing of high quality as the thermal head can be ensured for a long period of time.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A method of producing a thermal head, comprising:

forming a glaze layer on a substrate;

forming a heating resistor on the glaze layer; and adjusting a resistive value of the heating resistor to a predetermined value by applying to the heating resistor a number of pulses at a pre-specified power level, the number of pulses being determined by a relationship between numbers of pulses and resistance change rates.

2. The method of claim 1 further comprising vacuum annealing the heating resistor at a temperature that corresponds to a resistance change rate determined during the adjusting.

3. A method for producing a thermal head, comprising:

forming a glaze layer on a substrate;

forming a plurality of heating resistors on the glaze layer; and adjusting a resistive value of each of the heating resistors to a predetermined value by applying to each of the heating resistors a corresponding number of pulses at a pre-specified power level, the corresponding number of pulses being determined by a relationship between numbers of pulses and resistance change rates and a measured resistance value of each of the heating resistors.

4. The method of claim 3 further comprising vacuum annealing the heating resistors at a temperature that corresponds to a resistance change rate of the heating resistors determined during the adjusting.

5. A method of producing a thermal head, comprising:

setting a first power level based on conditions that the thermal head is to operate;

generating a first relationship between numbers of pulses and resistance change rates of a heating resistor of the thermal head for the first power level;

selecting a first number of pulses to apply to the heating resistor that sets a resistance value of the heating resistor to a predetermined resistance value based on the first relationship; and applying the first number of pulses at the first power level to the heating resistor.

6. The method of claim 5, further comprising:

generating a second relationship between annealing temperatures and resistance change rates for the heating resistor;

selecting an annealing temperature based on the second relationship and a resistance rate based on the first number of pulses applied to the heating resistor; and annealing the heating resistor at the selected annealing temperature.

7. The method of claim 6 further comprising annealing the heating resistor between approximately 20 to 60 minutes.

8. The method of claim 5, further comprising:

setting a second power level based on conditions that the thermal head is to operate;

generating a second relationship between the numbers of pulses and the resistance change rates of the heating resistor of the thermal head for the second power level;

measuring an actual resistance value of the heating resistor;

selecting a second number of pulses to apply to the heating resistor that sets a resistance value of the heating resistor to a predetermined resistance value based on the first relationship and the actual resistance value of the heating resistor; and applying the second number of pulses at the second power level to the heating resistor.

* * * * *